United States Patent [19]

Coppedge

[11] Patent Number: 4,917,190

[45] Date of Patent: Apr. 17, 1990

[54] OIL WELL BLOWOUT CONTAINMENT SYSTEM

[76] Inventor: Donnie R. Coppedge, 11671 Norgrove La., Los Alamitos, Calif. 90720

[21] Appl. No.: 214,198

[22] Filed: Jun. 27, 1988

[51] Int. Cl.[4] ..... E21B 33/08

[52] U.S. Cl. ..... 166/379; 166/84; 166/113; 277/2; 277/20; 277/59

[58] Field of Search ..... 166/81, 82, 84, 93, 166/72, 68, 379; 277/2, 19, 20, 21, 59, 110

[56] References Cited

U.S. PATENT DOCUMENTS

| | | | |
|---|---|---|---|
| 1,418,612 | 6/1922 | Beard . | |
| 1,448,243 | 3/1933 | Wilson | 166/81 |
| 1,594,935 | 8/1926 | Force | 277/19 X |
| 1,971,542 | 8/1934 | Taylor | 277/19 X |
| 2,096,882 | 10/1937 | Chernosky | 166/81 |
| 2,915,975 | 12/1959 | Kittrell et al. . | |
| 3,163,430 | 12/1964 | Normand | 166/84 X |
| 3,180,134 | 4/1965 | Wadlington | 277/3 X |
| 3,209,830 | 10/1965 | Orr et al. | 166/84 |
| 3,270,810 | 9/1966 | Johnston | 166/84 |
| 3,322,198 | 5/1967 | McHenry | 166/81 |
| 3,353,606 | 11/1967 | Dyer | 166/84 |
| 3,468,374 | 9/1969 | Reeves | 166/84 |
| 4,017,214 | 4/1977 | Smith | 417/9 |
| 4,530,397 | 7/1985 | Calhoun | 166/81 X |
| 4,647,050 | 3/1987 | Johnson | 277/19 |
| 4,665,976 | 5/1987 | Retherford | 166/81 |

*Primary Examiner*—Stephen J. Novosad
*Attorney, Agent, or Firm*—Howard A. Kenyon

[57] ABSTRACT

An oil well blowout containment system which surrounds the polished rod is provided that will capture the oil leaking and blowing past the stuffing box packing gland. In addition, a vessel which is part of the oil well blowout containment system and is located above and sealingly attached to the stuffing box is filled approximately two-thirds of its capacity with a lubricating fluid. The vessel's contents which are in fluid communication with the stuffing box packing gland provide lubrication to the stuffing box packing gland which will deter the wear and hence reduce the replacement of the stuffing box packing gland. A pressure gauge and/or a sight glass provides an indication to an inspector that the stuffing box packing gland has failed whereby the well pump may be shut down and the stuffing box packing gland replaced.

26 Claims, 2 Drawing Sheets

OIL WELL BLOWOUT CONTAINMENT SYSTEM

BACKGROUND OF THE INVENTION

1. Field of the Invention

This invention pertains to an oil well blowout containment systems used with a pumping oil well. More specifically, this invention provides a containment system that will prevent oil from polluting the area surrounding the oil well.

2. Description of the Prior Art

There are thousands of oil wells with pumping means to bring the oil to the surface from underground pools. Most of these oil wells have a pump at the bottom of the tubing which lifts a column of oil to the surface.

In the typical oil well pump, a sucker rod which extends down into the well tube is incorporated in the well tube to pump out the oil. The sucker rod is connected to a polished rod which passes through a stuffing box containing one or more packing glands. The polished rod is connected to a bridle which is in turn attached to a horse head on a horse head walking beam with counterweights attached to the other end of the beam. The pumping unit includes a driver motor which imparts the reciprocating motion to the polished rod.

Oil wells that are located close to populated areas present a catastrophic environment problem if the packing gland in the stuffing box fails and the crude oil is disbursed over the surrounding area. In some areas on the West Coast of the United States an oil well operator would be subject to heavy fines if the failed stuffing packing gland resulted in polluting the atmosphere, ground and possibly the water supply.

In other cases the production of the field may be marginal due to the depth of the well or the condition of the producing level. Therefore, many wells are now being injected with steam to increase their productivity. This not only makes the oil less viscous, but it frequently causes the oil to be delivered to the surface under substantial pressure. Now that increased pressures are being generated, the avoidance of bad environmental conditions are an extremely important consideration.

If a packing gland in a stuffing box starts leaking and is not corrected promptly, it may reach excessive levels as the wear by the action of the polished rod increases from continuation of the pumping operation. This excessive wear may also be due to the sand and water sometimes present in the crude oil being pumped. Polished rods, under normal use, will pit and corrode from the various acids present in the crude oil being pumped. In addition, sometimes the production of oil stops due to the well "pumping off" which is defined as the pump becoming gas locked. A gas bubble will occur at the pump at the bottom of the well and work its way to the top to the packing glands. When this happens, the packing in the stuffing box may become damaged due to periods of inadequate lubrication.

Many of the oil wells are dispersed over a wide area and therefore are inspected only occassionally due to the distance involved and the problem of manpower requirements for more frequent observation. If the packing gland in the stuffing box fails in these cases, in addition to the environmental impact, there could be a heavy financial loss, if the failure was not immediately discovered.

What is needed is a device that can contain the crude oil in cases of either a leak or a blowout of the stuffing box packing gland, in addition to providing lubrication to the packing gland at all times. The lubricant in the present invention contains a corrosion inhibitor that will assist in preventing pitting of the polished rod in addition to a lubricating agent that will, under heat and pressure, fill in the microscopic pits and cracks that are normal after any metal surface is machined. This device must also provide means to an inspector that the packing gland has failed and needs replacement.

Prior to this invention, several attempts have been made to contain the oil when a stuffing box packing gland failed. Once such device is described by U.S. Pat. No. 2,915,975 to Kittrell et al. This device measures the leakage past the stuffing box packing gland. Depending on the requirements, the leak rate may be predetermined to shut off the pumping motor and start it again. This does not allow for an inspector to determine the rate of leakage to known when a packing gland should be replaced. In fact, the starting and stopping of an electric motor would be hard on the system and this method would not work for an internal combustion engine at all.

Another device for a leak retriever at the oil well packing gland is given by Smith in U.S. Pat. No. 4,017,214. Smith proposes a complex device that has a small side pump activated by the polished rod reciprocating which pumps the leaked oil back into the discharge line. Again, this device while pumping the oil back into the discharge line, has no means to determine the rate of leakage so that an inspector can determine when the packing gland require replacement.

Another device for leak detection is provided by U.S. Pat. No. 3,180,134 to Wadington. Wadington provides a system very similar to Kitrell except that Wadington provides a pump run by the prime mover to keep a lubricant in the stuffing box between an upper and lower gland under pressure. When the leakage reaches a certain rate, the pressure in the system will drop and activate a switch while will shut down the oil well motor.

Other types of leak containment devices place a bonnet around the stuffing box. These are described in U.S. Pat. No. 3,270,810 to Johnston, U.S. Pat. No. 3,322,198 to McHenry and U.S. Pat. No. 4,665,976 to Retherford.

The novel features which are believed to be characteristics of the invention, both as to its organization and its method of operation, together with further objects and advantages thereof, will be better understood from the following description in connection with the accompanying drawings in which a presently preferred embodiment of the invention is illustrated by way of example. It is expressly understood, however, that the drawings are for purpose of illustration and description only, and are not intended as a definition of the limits of the invention.

SUMMARY OF THE INVENTION

It is the object of this invention to provide an oil well containment system to contain oil that leaks past a stuffing box packing gland.

It is another object of this invention to provide an oil well containment system to contain oil that blows past a stuffing box packing gland.

It is yet another object of this invention to provide lubricating means to insure that the stuffing box packing gland is lubricated at all times.

It is still another object of this invention to provide means for inspection to determine when to replace the stuffing box packing gland.

It is finally an object of this invention to provide an oil well stuffing box packing gland blowout containment system that is simple, easy to install, reliable and inexpensive.

Briefly, in accordance with this invention there is provided an oil well stuffing box packing gland blowout containment system that will contain oil that leaks or blows past the packing glands of an oil well stuffing box. A vessel is sealingly attached to the top of the stuffing box and is in fluid communication with the stuffing box packing glands. The vessel is filled with a special oil mix which provides superior lubrication to the stuffing box packing glands. A pressure gage and/or a sight glass is provided to allow a person inspecting the oil well to determine if the oil well stuffing box packing glands have failed. Another embodiment provides a discharge line from the vessel containing the lubricant to a storage facility where the primary discharge line termintes. The present invention is simple, reliable and inexpensive to manufacture.

These and other objects, features and advantages of the present invention will become more readily apparent upon detailed consideration of the following description of a preferred embodiment with reference to the accompanying drawings.

DETAILED DESCRIPTION OF THE INVENTION

Figure 1:
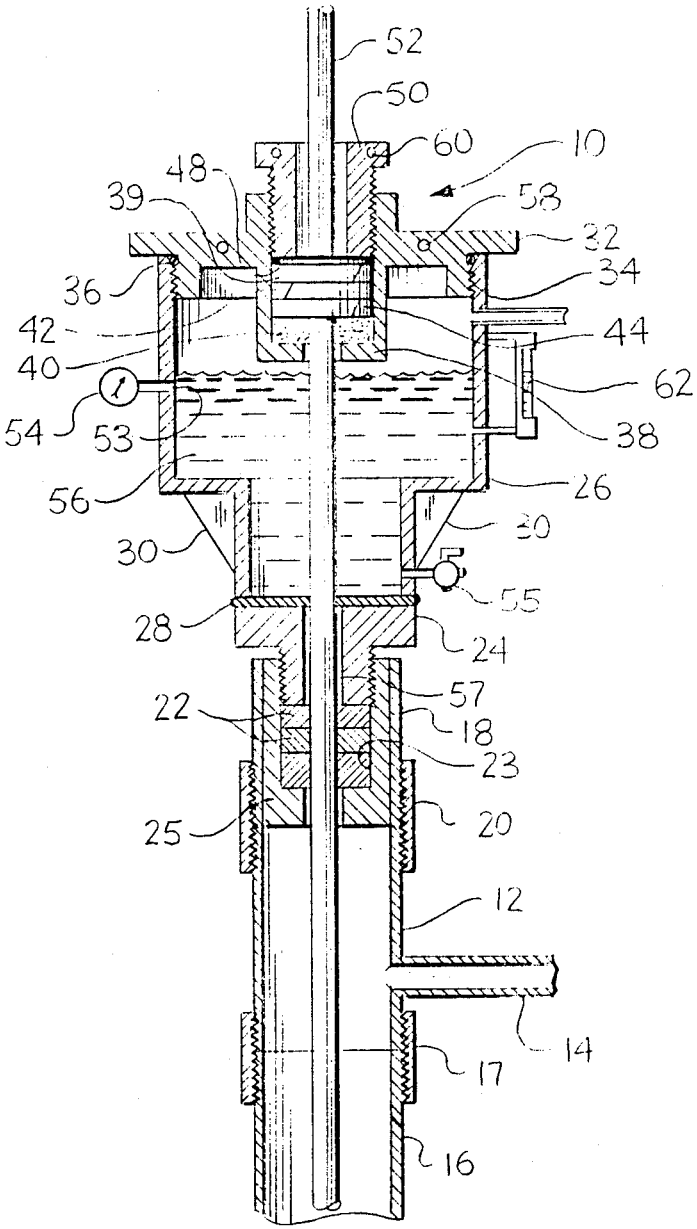
FIG. 1 is a partial cut away of the oil well blowout containment system.

Turning now to FIG. 1 there is shown an oil well blowout containment system attached to a stuffing box generally shown at 10. The system 10 is composed of a production tee 12 which has a discharge line 14 that discharges the crude oil into a storage facility (not shown). At the bottom of the production tee 12 and attached by coupling 17 is oil well tubing 16 which extends down into the oil well. A stuffing box 18 is located at the top end of production tee 12 and is attached by coupling 20. Inside the stuffing box 18 is one or more packing glands 22. Three packing glands 22 are shown in this illustration, however, sometimes the stuffing box has packing glands at the top and additional packing glands at the bottom of the stuffing box. A packing gland nut 24 is attached by threaded means to the inside of the stuffing box 8 and when turned provides a compression force on the packing glands 22. The packing glands 22 are placed in a bore 23 with an internal circular ledge 25 inside the stuffing box 18. It should be noted that there are other types of stuffing boxes other than the one described in FIG. 1. Some stuffing boxes have external bolts and clamping means to compress the packing glands. An adapter (not shown) may be required to mate the stuffing box to vessel 26 to provide a surface for welding means.

Located on top of a tubular base member 27 which is sealingly attached to the packing gland nut 24 is a vessel 26 that is sealingly attached to the top of the packing gland nut 24. In the preferred embodiment the sealing means of the tubular base member 27 to the packing gland nut 24 is by welding which is shown as 28. The vessel 26 contains at least 2 braces 30 to provide stability to the vessel. In the preferred embodiment there are 4 braces welded to the vessel 26 and located equidistant around the periphery of the vessel. Vessel 26 contains a cap 32 that is externally threaded and engages threads 34 on the inside of the upper part of vessel 26. An "o" ring 36 seals the cap 32 to vessel 26 when cap 32 is tightened. Cap 32 contains an internal bore with a bottom circular ledge 38 that contains a brass wear bushing 40 and packing glands 42. The preferred embodiment had 3 packing glands 42 as shown in FIG. 1, however, the present invention is not limited to a specific number of packing glands.

Figure 4:
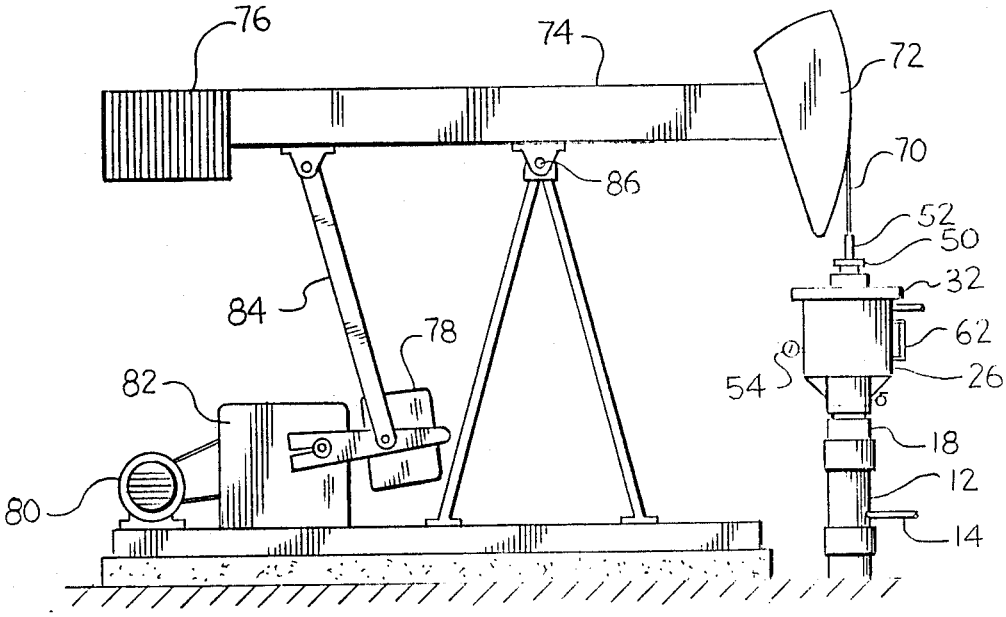
FIG. 4 shows an oil well pump system with a horse head walking beam and the oil well blowout containment system in place.

It is noted that packing glands 42 have a slanted cut 44 completely through each packing gland. This cut 44 is provided for easy removal and replacement whenever the packing glands 42 wear and fail. A metal ring 48 is provided that fits on top of the packing glands 42 so that even pressure may bear on packing glands 42 when being compressed. A packing gland nut 50 is also shown and when tightened forces the metal ring 48 and hence the packing glands 42 into a compressive state. Packing glands 42 are made from a resilient material. There are many resilient packing glands available on the present market, however the preferred embodiment uses synthetic rubber. Running the entire length of the oil well blowout containment system and the stuffing box is a polished rod 52. This rod is reciprocated by the power means 80 of the oil well as shown in FIG. 4. Also connected to vessel 26 is a pressure gauge 54 that measures the pressure in vessel 26. A petcock 55 is provided that will allow the vessel 26 to be drained.

Vessel 26 is partially filled with a lubricating mixture 56 that is comprised of approximately 60% to 80% by volume of high grade 30 weight motor oil approximately 20% to 30% by volume of polytetrafluoroethylene and approximately 0% to 10% by volume of corrosion inhibitor such as Visco 971. The above lubricating mixture composition contains particles of lubricating agents that under heat and pressure fill in the microscopic grooves, pit marks and scratches present in all machined metal surfaces. Thus, the polished rod 52 will not wear the packing gland 42 as readily when the polished rod 52 is coated with the present lubricant.

FIG. 1, which is the preferred embodiment, provides lubrication to packing glands 22 by the channel 57 between the polished rod 52 and the packing gland nut 24. In operation, the vessel 26 is fastened to stuffing box packing gland nut 24 preferably by welding. If the gland nut 24 is not preferably flat and isn't the same size as the bottom of vessel 26, an adapter (not shown) would have to be made to mate the bottom of vessel 26 to nut 24.

In order to fill the vessel 26, cap 32 is unscrewed and lifted up. The lubricant liquid 56 is poured in the vessel 26 until the pressure gauge opening 53 is covered. The cap 32 is screwed on and tightened by a spanner type wrench (not shown) using holes 58 until "o" ring 36 is compressed. After cap 32 is seated, wearing bushing 40, packing glands 42 and metal ring 48 are inserted into the bore 39. Packing gland nut 50 is tightened by a spanner wrench using holes 60 until packing glands 42 are compressed.

If packing gland 22 fails, the crude oil will flow into vessel 26 and create a pressure in vessel 26 where the fluctuations in pressure at gauge 54 can provide an inspector with the magnitude of the failure.

Figure 2:
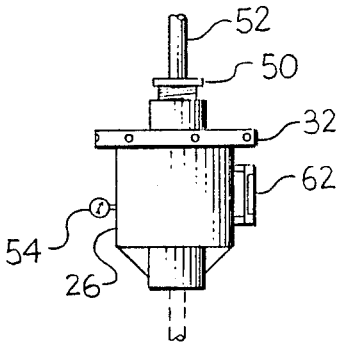
FIG. 2 is a view of the oil well blowout containment system showing the addition of a sight glass.

Turning now to FIG. 2, there is shown an embodiment containing a sight glass 62. This will provide an inspector with additional information as to the color of the lubricant 56 in vessel 26. Since the initial lubricant 56 is clear and crude oil is black, a leak in packing gland 22 will show a dark color in the sight glass 62.

Figure 3:
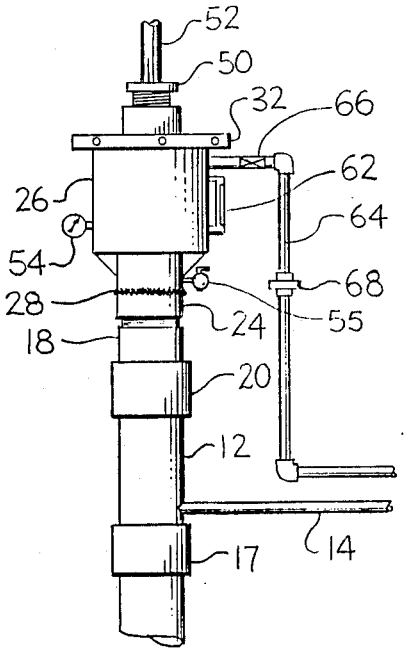
FIG. 3 is a view of the oil well blowout containment system which is the same as shown in FIG. 2 with the addition of a discharge line to a storage facility.

FIG. 3 shows the same embodiment as in FIG. 2 but with a discharge line 64 connected to the top of the vessel 26. The discharge line 64 is connected to the same storage facility as discharge pipe 14. Also in line in discharge line 64 is a check valve 66 which allows a positive pressure inside vessel 26. Discharge line 64 also contains a coupling 68 to facilitate removing vessel 26 which will be required if packing glands 22 in stuffing box 18 are replaced. Although 64 is shown as a pipe, a flexible hose could be used between coupling 68 and vessel 26.

FIG. 4 shows a standard "horse head walking beam" pump system with the oil well blowout containment system 10 in place. Vessel 26, stuffing box 18 and production tee 12 are all shown in connected relationships. The polished rod 52 is shown being reciprocated through the vessel 26, and stuffing box 18. A bridle 70 is attached to the horse head 72 which moves the polish rod 52 as the horse head 72 moves up and down. Other members of the pump system are the walking beam 74, counterweight 76, counterweight 78, motor 80 and gearbox 82. The gearbox 82 provides translating action of arm 84 which moves beam 74 up and down on one end. Pivot 86 attached to walking beam 74 provides translating motion to the horse head 72.

Thus, it is apparent that there has been provided in accordance with the invention a blowout containment system that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and variations that fall within the spirit and scope of the appended claims.

What is claimed is:

1. A method for oil well packing gland blowout containment for use with an oil well pump having an oil well tube with an upper discharge end, a stuffing box with an axial passage therethrough, a polished rod reciprocating and enclosed within said stuffing box comprising:

providing a stuffing box body having means for connecting the lower end of said body to the top end of said oil well tube;

providing a stuffing box seal assembly located inside said stuffing box, said stuffing box seal assembly having at last one packing gland surrounding said polished rod, said seal assembly also having adjustable packing gland compression means, said packing gland compression means being an adjustable packing gland nut engaged in said oil containment means;

providing an oil discharge line connected in fluid communication with said upper discharge end of said well tube;

providing oil containment means located above said stuffing box with said polished rod reciprocally disposed in said oil containment means, said oil containment means having an axial passage therethrough, said oil containment means being sealed and containing at last one compressible packing gland and a packing gland spacer which are disposed around said polished rod, said oil containment means being a vessel located above and being attached to said stuffing box, said vessel being filled with a lubricating fluid composed of approximately 60 to 80 percent by volume of high grade 30 weight motor oil, approximately 20 to 30 percent volume of polytetrafluoroethylene and approximately 0 to 10 percent by volume of corrosion inhibitors and providing means for fluid communication between said oil containment means and said stuffing box packing glands.

2. A method for oil well packing gland blowout containment as described in claim 1 wherein oil containment means is sealed and contains a wear bushing, at last one compressible packing gland and a packing gland spacer, which are all disposed around said polished rod.

3. A method for oil well packing gland blowout containment as described in claim 1 wherein said packing gland is compressed by an adjustable packing gland nut engaged in said oil containment means.

4. A method for oil well packing gland blowout containment as described in claim 1 wherein said oil well containment means is a vessel located above and attached to said stuffing box, said vessel being filled with a lubricating fluid composed of approximately 60% to 80% by volume of high grade 30 weight motor oil, approximately 20% to 30% by volume of polytetrafluoroethylene and approximately 0% to 10% by volume of corrosion inhibitor.

5. An oil well packing gland blowout containment system for use with an oil well pump having an oil well tube with an upper discharge end, a stuffing box with an axial passage therethrough, a polished rod enclosed within said stuffing box reciprocated by said oil well pump comprising:

a stuffing box body having means for connecting the lower end of said body to the top end of said oil well tube;

a stuffing box seal assembly located inside said stuffing box, said stuffing box seal assembly having at least one packing gland surrounding said polished rod, said seal assembly also having adjustable packing gland compression means;

an oil discharge line connected in fluid communication with said upper end of said well tube and, said discharge line terminating in a storage facility;

oil containment means located above said stuffing box having an axial passage therethrough with a polished rod reciprocally disposed therein, said oil containment means also having a tubular base member where the lower end of said tubular base member is connected to the upper end of said stuffing box by welding;

means for providing fluid communication between said oil containment means and said stuffing box packing glands.

6. An oil packing gland well blowout containment system as described in claim 5 wherein said attaching means is by welding.

7. An oil well packing gland blowout containment system as described in claim 5 wherein said oil containment means has a vessel with a cap thereon, said vessel located above and connected to the upper end of said tubular base member.

8. An oil well packing gland blowout containment system as described in claim 7 wherein said vessel contains sealing means between said cap and the upper edges of said vessel.

9. An oil well packing gland blowout containment system as described in claim 8 wherein said sealing means is a compressible elastic seal.

10. An oil well packing gland blowout containment system as described in claim 7 wherein said vessel has a pressure gauge in fluid communication attached to the side of said vessel.

11. An oil well packing gland blowout containment system as described in claim 7 wherein said vessel has a sight glass in fluid communication attached to the side of said vessel.

12. An oil well packing gland blowout containment system as described in claim 7 wherein said vessel has a controllable bleed valve.

13. An oil well packing gland blowout containment system as described in claim 7 wherein said vessel has a return line from said vessel in fluid communication with said oil storage facility.

14. An oil well packing gland blowout containment system as described in claim 13 wherein said return line has an in-line check valve between said vessel and said oil storage facility.

15. An oil well packing gland blowout containment system as described in claim 13 wherein said return pipe contains coupling means to enable said return pipe to be disconnected.

16. An oil well packing gland blowout containment system for use with an oil well pump having an oil well tube with an upper discharge end, a stuffing box with an axial passage throughout, a polished rod enclosed within said stuffing box reciprocated by said oil well pump comprising:

a stuffing box body having means for connecting the lower end of said body to the top end of said oil well tube;

a stuffing box seal assembly located inside said stuffing box, said stuffing box seal assembly having at least one packing gland surrounding said polished rod, said seal assembly also having adjustable packing gland compression means;

an oil discharge line connected in fluid communication with said upper end of said well tube and, said discharge line terminating in a storage facility;

oil containment means located above said stuffing box having an axial passage therethrough with a polished rod reciprocally disposed therein, said oil containment means also having a tubular base member where the lower end of said tubular base member is connected to the upper end of said stuffing box by welding;

means for providing fluid communication between said oil containment means sand said stuffing box packing glands;

a vessel located above and connected to the upper end of said tubular base member;

a cap threadably attached to the upper end of said vessel having a compressible elastic seal between said cap and the upper edges of said vessel, said cap adapted to be tightened or loosened with a spanner type wrench.

17. An oil well packing gland blowout containment system as described in claim 16 wherein said vessel has a cap threadably attached to the upper end of said vessel.

18. An oil well packing gland blowout containment system as described in claim 17 wherein said cap has a bore enclosed at one end for holding a wear bushing, at least one compressible packing gland and a packing gland spacer, which are all disposed around said polish rod.

19. An oil well packing gland blowout containment system as described in claim 18 wherein said wear bushing and said packing glands have a bore that various from 1⅛ inches to 1½ inches to accommodate various sizes of said polished rods.

20. An oil well packing gland blowout containment system as described in claim 17 wherein said cap is adapted to be tightened or loosened with a spanner type wrench.

21. An oil well packing gland blowout containment system as described in claim 17 whrein said cap has a packing gland adjusting nut threadably engaged with said bore to provide compressing means to said packing gland.

22. An oil well packing gland blowout containment means as described in claim 21 wherein said packing gland adjusting nut is adapted to be tightened or loosened by a spanner type wrench.

23. An oil well packing gland blowout system for use with an oil well pump having an oil well tube with an upper discharge end, a stuffing box with an axial passage therethrough, a polished rod enclosed within said stuffing box reciprocated by said oil well pump comprising:

a stuffing box body having means for connecting the lower end of said body to the top end of said oil well tube;

a stuffing box seal assembly located inside said stuffing box, said stuffing box seal assembly having at least one packing gland surrounding said polished rod, said seal assembly also having adjustable packing gland compression means;

an oil discharge line connected in fluid communication with said upper end of said well tube and, said discharge line terminating in a storage facility;

oil containment means located above said stuffing box having an axial passage therethrough with a polished rod reciprocally disposed therein, said oil containment means also having a tubular base member where the lower end of said tubular base member is connected to the upper end of said stuffing box by welding;

means for providing fluid communication between said oil containment means and said stuffing box packing gland;.

a vessel located above and connected to the upper end of said tubular base member;

a cap threadably attached to the upper end of said vessel having a compressible elastic seal between said cap and the upper edges of said vessel, said cap adapted to be tightened or loosened with a spanner type wrench;

a bore, enclosed at one end, in said cap for holding a wear backing, at last one compressible packing gland and a packing gland spacer, which are all disposed around said polished rod;

a packing gland adjusting nut threadably engaged with said base to provide compressing means to said packing gland, said packing adjusting nut is adapted to be adjusted with a spanner type wrench.

24. An oil well packing gland blowout containment system as described in claim 23 wherein said lubricating oil is comprised of approximately 60% to 80% by volume of high grade 30 weight motor oil, approximately 20% to 30% by volume of polytetrafluoroethylene and approximately 0% to 10% by volume of a corrosion inhibitor.

25. An oil well packing gland blowout containment system for use with an oil well pump having an oil well tube with an upper discharge end, a stuffing box with an axial passage therethrough, a polished rod enclosed within said stuffing box reciprocated by said oil well pump comprising:

a stuffing box body having means for connecting the lower end of said body to the top end of said oil well tube;

a stuffing box seal assembly located inside said stuffing box, said stuffing box seal assembly having at least one packing gland surrounding said polished rod, said seal assembly also having adjustable packing gland compression means;

an oil discharge line connected in fluid communication with said upper end of said well tube and, said discharge line terminating in a storage facility;

oil containment means located above said stuffing box having an axial passage therethrough with a polished rod reciprocally disposed therein, said oil containment means also having a tubular base member where the lower end of said tubular base member is connected to the upper end of said stuffing box by welding;

means for providing fluid communication between said oil containment means and said stuffing box packing glands;

a vessel located above and connected to the upper end of said tubular base member;

a cap threadably attached to the upper end of said vessel having a compressible elastic seal between said cap and the upper edges of said vessel, said cap adapted to be tightened or loosened with a spanner type wrench;

a bore, enclosed at one end, in said cap for holding a wear backing, at last one compressible packing gland and a packing gland spacer, which are all disposed around said polished rod;

a packing gland adjusting nut threadly engaged with said base to provide compressing means to said packing gland, said packing adjusting nut is adapted to be adjusted with a spanner type wrench;

a pressure guage in fluid communication attached to the side of said vessel;

a sight glass in fluid communication attached to the side of said vessel;

a controllable bleed valve connected to said vessel;

a return line, having an in line check valve, in fluid communication with said oil storage facility;

coupling means between said storage facility and said vessel to enable said return pipe to be disconnected;

wear bushing and packing gland bores varying from $1\frac{1}{8}$ inches to $1\frac{1}{2}$ inches to accommodate various sizes of said polished rods.

26. A method for oil well packing gland blowout containment for use with an oil well pump having an oil well tube with an upper discharge end, a stuffing box with an axial passage there through, a polished rod reciprocating and enclosed within said stuffing box comprising:

providing a stuffing box body having means for connecting the lower end of said body to the top end of said oil well tube;

providing a stuffing box seal assembly located inside said stuffing box, said stuffing box seal assembly having at least one packing gland surrounding said polished rod, said seal assembly also having adjustable packing gland compression means;

providing an oil discharge line connected in fluid communication with said upper discharge end of said well tube;

providing oil containment means located above said stuffing box with said polished rod reciprocally disposed in said oil containment means, said oil containment means having an axial passage there through;

providing means for fluid communication between said oil containment means and said stuffing box packing glands;

providing oil containment sealing means, wear bushing, at least one compressible packing gland and a packing gland spacer, all of which are disposed around said polished rod;

providing an adjustable packing gland not in said oil containment means where said packing gland is compressed by said packing gland nut;

filling said vessel with a lubricating fluid composed of approximately 60% to 80% by volume of high grade 30 weight motor oil, approximately 20% to 30% by volume of polytetrafluoroethylene and approximately 0% to 10% by volume of corrosion inhibitor.

* * * * *